US007066074B2

(12) United States Patent
Lin et al.

(10) Patent No.: US 7,066,074 B2
(45) Date of Patent: Jun. 27, 2006

(54) FLUID MOTOR

(75) Inventors: Kun-Tzu Lin, Tainan (TW); Shih-Liang Cheng, Tainan (TW); Cheng-Chiang Chuang, Tainan (TW); Chung-Yu Tsai, Changhua (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 33 days.

(21) Appl. No.: 10/733,021

(22) Filed: Dec. 11, 2003

(65) Prior Publication Data

US 2005/0126386 A1 Jun. 16, 2005

(51) Int. Cl.
*F15B 15/22* (2006.01)

(52) U.S. Cl. ..... 91/394

(58) Field of Classification Search ..... 91/394, 91/409; 92/85 B
See application file for complete search history.

(56) References Cited

U.S. PATENT DOCUMENTS

| | | | | |
|---|---|---|---|---|
| 3,592,106 | A * | 7/1971 | Baughman | 92/85 R |
| 4,089,251 | A * | 5/1978 | Louviot | 91/408 |
| 5,018,934 | A * | 5/1991 | Steinkamp et al. | 92/85 B |
| 5,657,511 | A | 8/1997 | Lan | |
| 6,000,314 | A | 12/1999 | Masuda et al. | |
| 6,230,606 | B1 | 5/2001 | Sato | |

* cited by examiner

*Primary Examiner*—F. Daniel Lopez
(74) *Attorney, Agent, or Firm*—Slater & Matsil, L.L.P.

(57) ABSTRACT

The piston of a fluid motor divides the cylinder into two variable volumes into which and from which fluid may be selectively introduced and exhausted via ports through the cylinder to relatively move the piston and the cylinder. The piston is modified to define two fixed-volume chambers that respectively communicate with the variable volumes via restrictive orifices. In selected relative piston-cylinder positions, the chambers communicate with the ports to restrict fluid flow into and out of the variable volumes and to decrease the velocity of relative piston-cylinder movement. In other relative piston-cylinder positions, the chambers do not communicate with the ports and fluid enters and leaves the variable volumes directly through the ports to relatively move the piston-cylinder at a higher velocity.

17 Claims, 3 Drawing Sheets

FLUID MOTOR

TECHNICAL FIELD

The present invention relates to a fluid motor, and more particularly to a linear fluid motor having facilities for selectively moderating the velocity of a movable piston of the motor at the beginning and end of each piston stroke.

BACKGROUND

The expeditious fabrication of semiconductor devices requires an extremely clean environment and high throughput. Various chambers are utilized during such fabrication for depositing materials on substrates and for annealing, or heating, and otherwise treating the in-process devices. Fabrication steps effected in such chambers may produce particulates that adhere to the interior surfaces of the chambers. The particulates may subsequently become dislodged from the interior surfaces and fall onto the in-process devices, thereby introducing undesirable impurities into the in-process devices.

Because of high throughput requirements, it is deemed undesirable to clean the chambers to remove adherent particulates after each fabrication step carried out therein. Such cleaning after each use of the chambers would slow down fabrication flow.

Most fabrication chambers contain controlled environments during the processing of semiconductor devices therewithin. These environments may include extremely low pressures, particular gases, and high temperatures. Typically, the chambers are closed by sealing an opening thereinto with a door before processing is initiated. The motive power for opening and closing the door may be derived from the operation of a linear fluid motor.

The opening and closing of a processing chamber door by a fluid linear motor has been identified as a source of particulate contamination of in-process devices within the chamber. Specifically, if the velocity of a piston of the motor that is connected to the door is too high at either end of its stroke—when the door is fully closed or opened—the high kinetic energy of the piston-door combination may vibrate the chamber, dislodging the potentially damaging particulates from the chamber surfaces. The velocity of the motor piston and the door may be slowed throughout movement thereof to minimize their combined kinetic energy and particulate dislodgement, but this expedient adversely affects throughput. The velocity of the piston-door may also be monitored and controlled by sensors and a control system, but this expedient adds expense to the fabrication equipment and requires constant maintenance and adjustment.

A simple, low cost solution to the foregoing is a desideratum of the present invention.

SUMMARY OF THE INVENTION

The present invention contemplates a linear fluid motor. Generally, the motor is of the type having a stationary cylinder with a piston movable therein, although those skilled in the art will recognize that the piston may be stationary and the cylinder movable.

In one aspect, the invention provides for a fluid motor having a stationary cylinder and a piston movable therein between end positions by selectively introducing or evacuating via a first port through a wall of the cylinder a pressurized fluid into or from a first variable volume of the cylinder on a first side of the piston and simultaneously evacuating or introducing via a second port through a wall of the cylinder the pressurized fluid from or into a second variable volume of the cylinder on a second side of the piston. The motor comprises means carried by and movable with the piston for restricting the introduction or evacuation of the fluid through either port as long as the piston is located at or less than a selected distance from one of its end positions to thereby limit the velocity of the piston during that time.

In a more particular aspect, the means comprises seals that define between the wall of the cylinder and the piston first and second fixed-volume chambers movable with the piston. The means further comprises first and second restrictive orifices, the first orifice interconnecting the first chamber with the first variable volume, and the second orifice interconnecting the second chamber with the second variable volume. The ports and the orifices being so related that, when the piston is located at or less than a selected distance away from the associated end position, the fluid that is introduced or evacuated into or from the associated variable volume enters or leaves the associated chamber and thereafter enters or leaves the associated variable volume via the associated restrictive orifice.

In another aspect, the invention provides for a linear fluid motor having a piston within a close-ended cylinder. The piston, the cylinder sidewall and the cylinder ends divide the cylinder into two variable volumes, the piston and the cylinder being relatively movable between first and second rest positions by selectively introducing a fluid through a first port into one of the variable volumes and simultaneously evacuating fluid through a second port from the other variable volume. The motor further comprises means carried by and movable with the piston (i) for restricting the introduction of the fluid into the one variable volume while the piston-cylinder is in the first rest position and until there has occurred a selected amount of relative movement out of the first rest position, (ii) for restricting the exhaustion of the fluid from the other variable volume until there can occur a selected amount of relative movement into the second rest position and while the piston-cylinder is in the second rest position, and (iii) for otherwise permitting unrestricted flow of the fluid into or out of the variable volumes to limit the velocity of the relative movement near the end positions.

DETAILED DESCRIPTION OF ILLUSTRATIVE EMBODIMENTS

Figure 1:
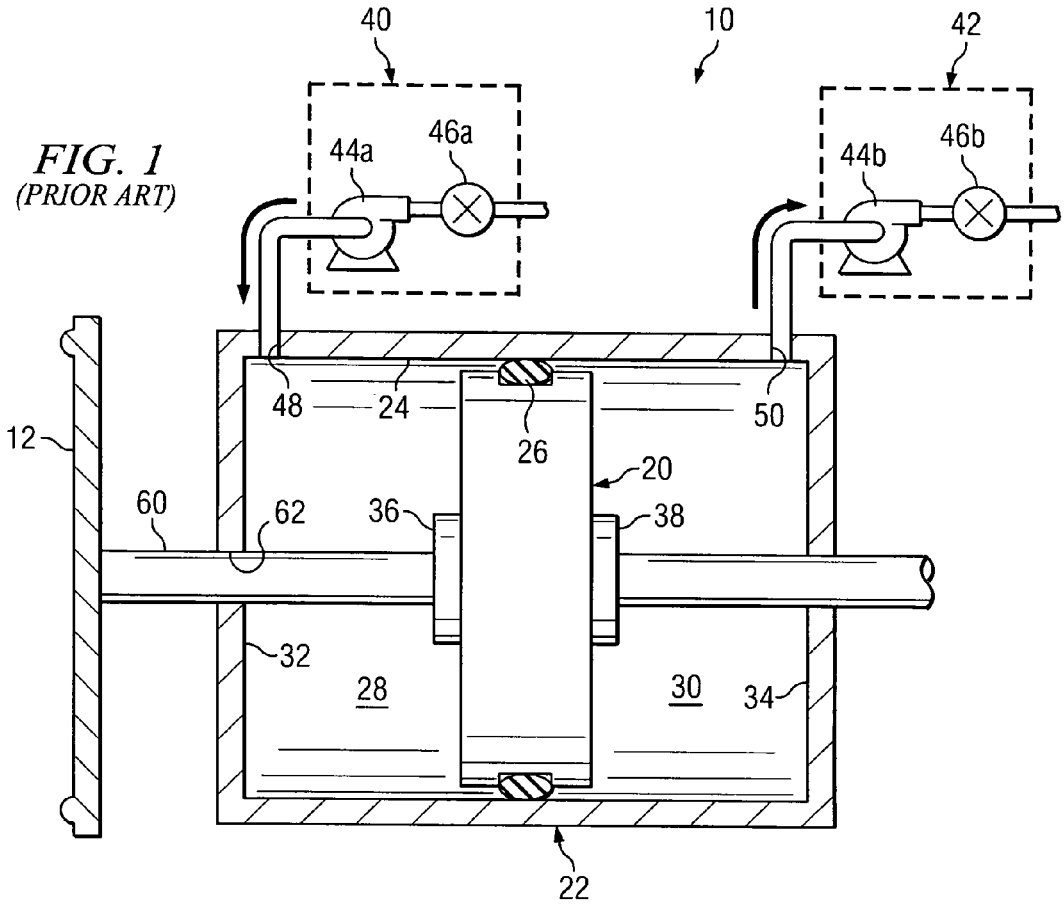
FIG. 1 (PRIOR ART)
FIG. 1 is a sectioned side view of a fluid motor according to the prior art.

In preferred embodiments of the invention, a piston and a cylinder define two variable volumes on either side of the piston. The piston is movable between end, or end-of-stroke, positions by selectively introducing or evacuating fluid into and out of the variable volumes. The fluid passes into and out of the variable volumes via respective ports through the cylinder sidewall. As fluid is introduced into one of the variable volumes via its port, the variable volume expands as the piston is moved thereby. As the other variable volume contracts, the fluid is evacuated therefrom via its port. This moves the piston in one direction. Reversing the direction of fluid introduction and evacuation reverses the direction of piston movement.

The improved motor includes facilities that limit or moderate the velocity of the piston. These facilities, which are carried by and move with the piston within the cylinder, restrict the introduction or evacuation of the fluid through one of the ports whenever the piston is located at, or less than a selected distance away from, one of its end positions.

In one embodiment, the limiting or restricting facilities include seals that define two fixed-volume chambers between the cylinder wall and the piston. These chambers move with the piston. Restrictive orifices communicate with the chambers and their associated variable volumes. The ports and the chambers are positionally related so that when the piston is located in one of its end positions, or is less than a selected distance away from that end position, the fluid must pass through both the associated chamber and its restrictive orifice before it enters or leaves the variable volume of the piston-cylinder.

Specifically, each fixed-volume chamber communicates with its associated port only when the piston is at or less than a selected distance away from one of its end positions. This is preferably achieved by forming the chambers with a dimension parallel to the direction of piston movement that is equal to the selected distance. When the piston is in an end position, one of the ports communicates with its associated chamber. As fluid enters the chamber from the port, it passes through the restrictive orifice and into the associated variable volume and begins to move the piston. Initial piston movement is slow because of the restrictive effect of the orifice. During some amount of initial movement of the piston and the chamber, the chamber remains in communication with the port as the chamber moves therepast. At some point in its travel, the chamber moves past the orifice. The fluid now acts directly on the piston and is no longer moderated by passage through the orifice.

As the other end of piston travel is approached, the other chamber is initially not in communication with its port. Continued chamber movement brings the two into communication, at which time the amount of fluid leaving the decreasing variable volume is restricted by its movement through the orifice, the chamber and the associated port. In the above manner, the velocity of the piston at the inception of its movement and at the end of its movement is restricted and decreased to provide for a "gentle" landing.

Referring to FIG. 1, there is shown a generalized cross-sectional side view of a fluid motor 10 according to the prior art. A particular use environment for the prior art motor 10 is the opening and closing of a door 12 for a treatment chamber used in the fabrication of semiconductor devices. For reasons set forth above, it is desired to limit or restrict the velocity of the door 12 during full opening and full closing thereof, while moving the door toward either position at a reasonably fast velocity. It is also desired to achieve these ends without resorting to complicated structures, sensors or control systems.

The motor 10 includes a piston 20 movable within a cylinder 22. The piston 20 may be conformal to the sidewall 24 of the cylinder 22 or may include a seal 26 such as an O-ring or piston ring mounted on the piston 20 and movable therewith. The piston 20 and/or its seal 26 divide and isolate the interior of the cylinder 22 into two variable volumes 28 and 30 defined by the respective sides of the piston 20, the cylinder sidewall 24 and respective end walls 32 and 34 of the cylinder 22. The end positions of the piston 20 may be determined by the impact of piston-carried impact members or cushions 36 and 38 on either side of the piston 20. The left end-of-stroke position is set by the impact of the cushion 36 against the end wall 32; the right end-of-stroke position is set by the cushion 38 impacting the end wall 34.

Introducing a fluid, such as clean dry air, into the first variable volume 28 exerts a rightward force on the piston 20. The rightward force moves the piston 20 rightwardly away from the end wall 32 and toward the end wall 34 if the piston 20 is free to so move. The piston is free to move if fluid is evacuated, or is free to evacuate, from the variable volume 30 as the piston 20 moves. Similarly, introducing a fluid into the variable volume 30 moves the piston 20 leftwardly if the fluid in the variable volume 28 is free to evacuate therefrom.

The introduction and evacuation of fluid into and from the chambers 28 and 30 is controlled by facilities 40 and 42 that include a fluid pump 44*a* and 44*b* shunted by a normally closed valve 46*a* and 46*b*. The output of one pump 44*a* is connected to a port 48 that communicates with the variable volume 28 through the sidewall 24 of the cylinder. The output of the other pump 44*b* is similarly connected to a port 50 communicating with the variable volume 30. To move the piston 20 to the right, the pump 44*a* is operated while its shunt valve 46*a* is closed, while the pump 44*b* is idle and the valve 46*b* is open. Operating the pump 44*b* with the valve 46*b* closed, the pump 44*a* idle, and the valve 46*a* open moves the piston to the left.

One end of a connecting rod 60 reciprocating through a sealed opening 62 through one end wall 32 of the cylinder 22 is carried by and moves with the piston 20. The other end performs work, such as opening and closing the door 12 of the chamber, as the piston 20 moves. The rod 60 may be elongated, as shown, to similarly pass through the other end wall 34 where its free end may perform work.

Figure 2:
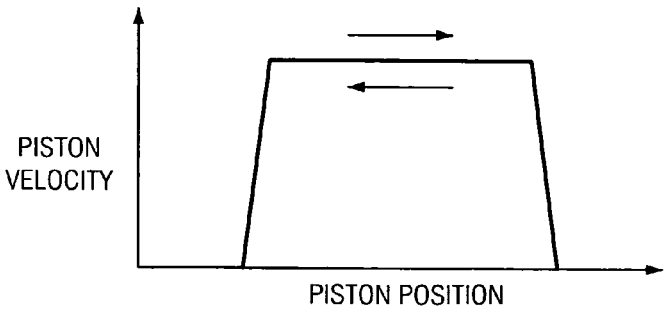
FIG. 2 (PRIOR ART)
FIG. 2 is a graph of the velocity of a piston of the motor of FIG. 1 versus the position of the piston within a cylinder of the motor.

FIG. 2 is a graph of the velocity of the piston 20 versus its position as it moves during operation of the prior art motor 10. The steep, nearly vertical rise and fall in velocity V as movement of the piston 20 is initiated or ceases results in the combined mass M of the piston-rod-door 20-60-12 possessing high kinetic energy ($MV^2/2$). High kinetic energy produces high impact forces as the cushions 36 and 38 contact the end walls 32 and 34 to rapidly decelerate the mass 20-60-12. These decelerative impact forces, in turn, are directly transferred to the chamber (not shown) when the door 12 is closed, if the chamber and the motor 10 are not mechanically isolated from each other. The transferred impact forces cause particulate matter on the interior surfaces of the chamber to fall onto an in-process device therewithin.

Moreover, when movement of the piston 20 is initiated, the fast acceleration of the mass 20-60-12 creates high forces in the motor-door system 10-12. These forces may also be the cause of particulate contamination within the chamber.

Figure 4:
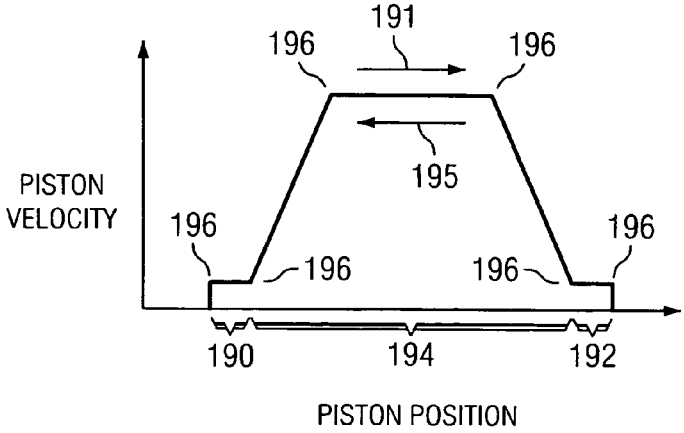
FIG. 4 is a graph of the velocity of the piston of the motor of FIG. 3 versus the position of the piston within the cylinder of the motor.

A motor 100, according to preferred embodiments of the present invention, eliminates or ameliorates these impact forces as shown by a graph, FIG. 4, of piston position versus piston velocity. FIG. 4 indicates that the velocity, and hence the kinetic energy, of a piston-rod-door combined mass, is kept low at the time the piston starts and stops.

Figure 3:
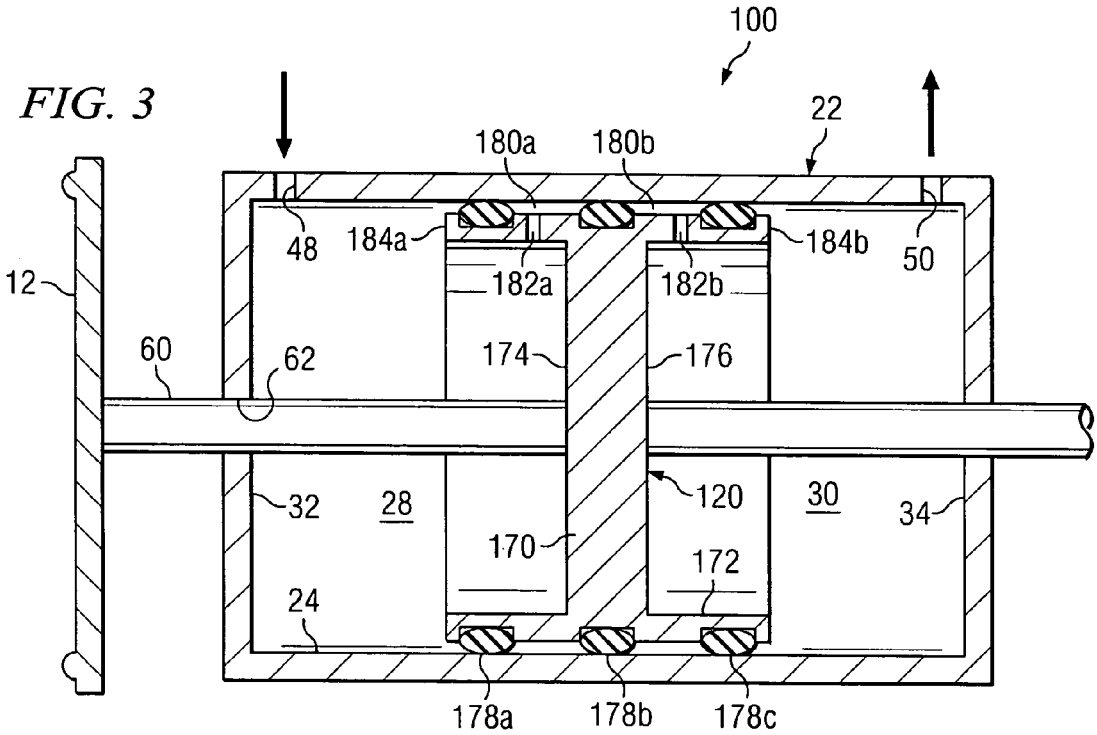
FIG. 3 is a sectioned side view of a fluid motor according to a first embodiment of the present invention, comprising a modification of the motor shown in FIG. 1.

As shown in FIG. 3, the motor 100 includes a piston 120 that differs from the piston 20 of the prior art motor 10. The piston 120 includes a body 170 that carries on its periphery a cylinder-congruent member 172 projecting away from first and second sides 174 and 176 of the body 170.

The member 172 carries three seals 178*a*, 178*b* and 178*c*, in the form of O-rings or the like in sliding, sealing engagement with the sidewall 24 of the cylinder 22. The seals 178*a* and 178*c* define the isolated variable volumes 28 and 30, respectively. The seals 178*a* and 178*b* define a fixed-volume chamber 180*a* in combination with the member 172 and the sidewall 24 of the cylinder 22. The seals 178*b* and 178*c*, the member 172 and the sidewall 24 define a fixed-volume chamber 180*b*. The chambers 180*a* and 180*b* are isolated from each other. If the cylinder 22 and the member 172 are right-circular cylinders, the chambers 180*a* and 180*b* are torroidal volumes that move with the piston 120 as it moves.

The fixed volume chamber 180*a* communicates with the variable volume 28 via a restrictive or throttling orifice 182*a* formed through the member 172. Similarly, the fixed volume chamber 180*b* communicates with the variable volume 30 via a restrictive orifice 182*b*. In other embodiments, two or more restrictive orifices could be employed for communication between fixed volume chamber 180*a* and variable volume 28. Likewise, two or more restrictive orifices could be employed for fluid communication between 180*b* and variable volume 30.

Ends 184*a* and 184*b* set the end-of-stroke positions of the piston 120 by abutting the respective end walls 32 and 34 of the cylinder 22. In the left end-of-stroke position of the piston 120, the port 48 communicates with the chamber 180*a* with the seal 178*b* to the right of the port 48. As the piston moves rightwardly, the port 48 continues to communicate with the chamber 180*a* until the seal 178*a* moves therepast. While the port 48 communicates with the chamber 180*a* fluid introduced into the port 48 by the pump 44*a* passes into the chamber 180*a*, and then through the restrictive orifice 182*a* and into the variable volume 28. After the chamber 180 ceases to be in communication with the port 48, fluid is introduced into the variable volume 28 directly through the port 48. The size of the orifice 182*a* is chosen to modulate or decrease the amount of fluid per unit time that can flow therethrough into the variable volume 28 with respect to the flow of the fluid directly into the variable volume 28 through the port 48.

Thus, for a given capacity of the pump 44*a* (shown in FIG. 1), the velocity of the piston 120 while the port 48 communicates with the fixed-volume chamber 180*a* is slower than is the case when the port 48 communicates directly with the variable volume 28. The distance of the end 184*a* of the member 172 from the side 174 of the body 170, the distance apart of the seals 178*a* and 178*b* (and, hence the length of the chamber 180*a* in the direction of movement of the piston 120), and the distance of the port 48 from the end wall 32 may all be selected so as to produce a selected profile for the portion 190 of the velocity versus position, as shown in the graph of FIG. 4. The profile portion 190 in FIG. 4 is merely exemplary, other profiles obviously being achievable.

As can be seen in FIG. 4, during the initial movement of the piston 120 away from the end wall 32, the piston velocity (as shown by the curve of FIG. 4), is quite low because of the throttling, restrictive effect of the orifice 182*a*. The reverse of this result is illustrated by the portion 192 of FIG. 4, which represents the velocity versus position profile of the piston 120 as it approaches the end wall 34. Until the seal 178*c* passes the port 50, fluid is exhausted from the decreasing variable volume 30 directly via the port 50. When the seal 178*c* passes the port 50, the exhausting fluid is constrained to flow through the orifice 182*b* into the chamber 180*b*, and from there through the port 50. When the end 184*b* of the member 172 abuts the end wall 34, the mass of the piston-rod-door 120-60-12 is moving at low velocity and possesses low kinetic energy. Thus, the end-end wall 184*b*-34 abutment produces low impact forces. Arrow 191 represents the direction of the velocity-position curve as piston 120 moves from left to right.

During movement of the piston 120 when neither chamber 180*a*, 180*b* is in communication with its corresponding port 48, 50 the piston 120 moves at higher velocity, as illustrated by the portion 194 of the profile of FIG. 4.

After the piston 120 resides in its extreme rightward position, it may be returned to its leftward position, following the direction of arrow 195 along the velocity-position curve of FIG. 4, by opening the valve 46*a*, closing the valve 46*b* and operating the pump 44*b* (FIG. 1). The profile of the velocity of the piston 120 versus its position is the reverse of that described above. In the illustrated embodiment, the profile of FIG. 4 is symmetrical. Variations of the relative locations and sizes of the ports 48 and 50, the seals 178*a–c*, the chambers 180*a–b* and the orifices 182*a–b* can, as should be obvious, produce a wide variety of asymmetrical and other symmetrical velocity versus position profiles.

Accordingly, the velocity of the piston 120 may be selectively lowered near either of its end-of-stroke positions without modulating the operation of the pump 44*a* and without the use of complicated controls.

Figure 6:
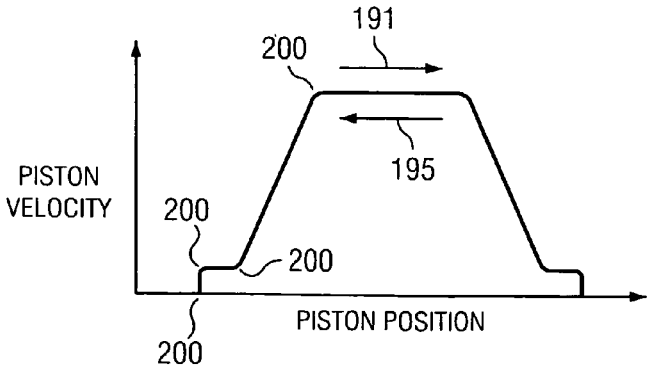
FIG. 6 is a graph of the velocity of the piston of the motor of FIG. 5 versus its position within the cylinder and constitutes a modification of FIG. 4.

In another embodiment of the motor 100 of the present invention, abrupt transitions, numbered 196 in FIG. 4, may be moderated, as shown in FIG. 6 at 200. This is achieved by altering the configuration of the ports 48 and 50 at the interior of the sidewall 24 of the cylinder 22.

Figure 5A:
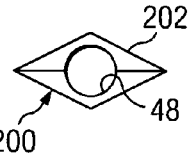
FIG. 5*a* is an orthogonal view of a portion of FIG. 5.
Figure 5:
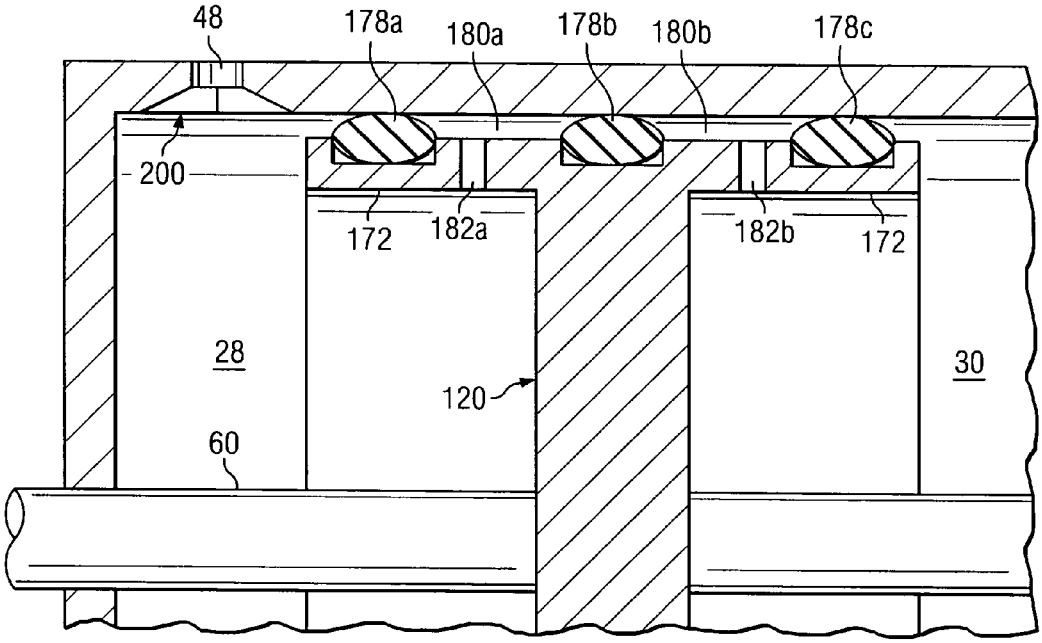
FIG. 5 is a magnified view of a portion of a second embodiment of a motor according to the present invention that is similar to, but modified from, the motor depicted in FIG. 3.

Specifically, as shown in FIGS. 5 and 5*a*, the ports 48 and 50 may be enlarged, as shown at 200. In the depicted embodiment, the enlargement 200 has a rhomboid cross-section 202 that is elongated and tapered in the direction of the movement of the piston 120. When the ports 48,50 are tapered in this manner, the passage of the seals 178*a*, 178*c* therepast permits a gradually decreasing or increasing area of the cross-section 200 to communicate with the chambers 180*a*,180*b* as the piston 120 is moved.

In FIG. 5, if the piston 120 is moving to the right, the seal 178*a* allows a gradually decreasing amount of fluid to enter the chamber 180*a*, which, in turn, leads to a gradually increasing amount of fluid entering the variable volume 28. If the piston 120 is moving leftwardly, the seal 178*a* causes a gradually increasing amount of the fluid to be exhausted via the chamber 180*a* and a gradually decreasing amount of fluid to be exhausted directly from the variable volume 28. Similar events occur as the seal 178*c*, the fixed volume chamber 180*b* and the port 50 interact. Cross-sections and tapered elongations other than those depicted in FIG. 5 are contemplated.

Particular embodiments of the invention are described herein. It is to be understood that the invention is not limited in scope thereby. Additional embodiments will be apparent to one skilled in the art upon reading this specification and with the benefit of routine experimentation. For instance, although the preferred embodiments employ air as the fluid, other fluids such as pressurized water, steam, hydraulic fluid, and the like could be employed. Although the invention was described with reference to a single cylinder, single piston arrangement, the present teaching could be applied to a multiple piston, multiple cylinder arrangement. Furthermore, the application of the motor described herein is not limited to opening and closing a chamber door. Numerous other applications could be employed wherein the velocity of a piston is restricted at one or both of the end points of its travel range. Furthermore, the teachings herein are not limited to restricting the piston velocity only at or near the end points of travel. It will be clear to one skilled in the art that the described embodiments could be readily extended to an arrangement whereby velocity is restricted at the midpoint or any intermediate point or points of the piston range of travel. The present invention includes the described embodiments and any modifications and equivalents covered by the following claims hereof.

What is claimed is:

1. A liner fluid motor having a piston within a close-ended cylinder, wherein the piston, the cylinder sidewall and the cylinder ends divide the cylinder into two variable volumes, the piston and the cylinder being relatively movable between first and second rest positions by selectively introducing a fluid through a first port into one of the variable volumes and simultaneously evacuating fluid through a second port from the other variable volume, comprising:

means carried by and movable with the piston (i) for restricting the introduction of the fluid into the one variable volume while the piston-cylinder is in the first rest position and until there has occurred a selected amount of relative movement out of the first rest position, (ii) for restricting the exhaustion of the fluid from the other variable volume until there can occur a selected amount of relative movement into the second rest position and while the piston-cylinder is in the second rest position, and (iii) for otherwise permitting unrestricted flow of the fluid into or out of the variable volumes to limit the velocity of the relative movement near the end positions, the restricting means including, seals located on the piston that define between the cylinder and the piston first and second fixed-volume chambers movable with the piston; and first and second restrictive orifices, the first orifice interconnecting the first chamber with the first variable volume, the second orifice interconnecting the second chamber with the second variable volume, the ports and the orifices being so related that, when the end positions are achieved and when the selected amount of relative movement has occurred or can occur, the fluid that is introduced or evacuated into or from the variable volume enters or leaves the associated chamber and thereafter enters or leaves the associated variable volume via the associated restrictive orifice; and wherein the first and second ports are respectively shaped so that as the fixed-volume chambers move into and out of communication therewith the rate of fluid movement into or out of the chambers changes gradually.

2. A fluid motor as in claim 1, wherein the velocity of the piston relative to the cylinder versus its position relative to the cylinder is as depicted in FIG. 4.

3. A fluid motor as in claim 1, wherein the velocity of the piston relative to the cylinder versus its position relative to the cylinder is as depicted in FIG. 6.

4. A linear fluid motor having a stationary cylinder and a piston movable therein between end positions by selectively introducing or evacuating via a first port through a wall of the cylinder a pressurized fluid into or from a first variable volume of the cylinder on a first side of the piston and simultaneously evacuating or introducing via a second port through a wall of the cylinder pressurized fluid from or into a second variable volume of the cylinder on a second side of the piston, comprising:

means carried by and movable with the piston for restricting the introduction or evacuation of the fluid through either port as long as the piston is located at or less than a selected distance from one of its end positions to thereby limit the velocity of the piston during that time, wherein the ports are shaped so that as the fixed-volume chambers move into and out of communication therewith the rate of fluid movement into or out of the chambers changes gradually.

5. A fluid motor as in claim 4, wherein the ports are elongated in the direction of movement of the fixed-volume chambers.

6. A fluid motor as in claim 5, wherein the elongation of the ports is tapered.

7. A fluid motor as in claim 6, wherein the ports have a rhomboid cross-section.

8. A fluid motor as in claim 4 wherein the means for restricting comprise seals.

9. A fluid motor as in claim 4, wherein each fixed-volume chamber communicates with its associated part only while the piston is located at or less than the selected distance away from the associated end position.

10. A fluid motor as in claim 4, wherein the fixed-volume chambers have a dimension parallel to the direction of movement of the piston that is equal to the selected distance.

11. A fluid motor as in claim 4, wherein:

each port communicates with its associated moving chamber until the chamber has moved therepast.

12. A fluid motor as in claim 4, wherein the velocity of the piston versus its position in the cylinder is as depicted in FIG. 6.

13. Fabrication equipment comprising:

a chamber configured to an in-process device;

an opening into the chamber;

a door operable to seal the opening;

a piston connected to and operable to close the door;

a fluid motor driving the piston, the fluid motor including:

a stationary cylinder receiving the piston, said piston movable therein between end positions by selectively introducing or evacuating via a first port through a wall of the cylinder a pressurized fluid into or from a first variable volume of the cylinder on a first side of the piston and simultaneously evacuating or introducing via a second port through a wall of the cylinder pressurized fluid from or into a second variable volume of the cylinder on a second side of the piston; and seals carried by and movable with the piston for restricting the introduction or evacuation of the fluid through either port as long as the piston is located at or less than a selected distance from one of its end positions to thereby limit the velocity of the piston during that time;

wherein the ports are shaped so that as the fixed-volume chambers move into and out of communication therewith the rate of fluid movement into or out of the chambers changes gradually.

14. The fabrication equipment of claim 13, wherein the ports are elongated in the direction of movement of the fixed-volume chambers.

15. The fabrication equipment of claim 14, wherein the elongation of the ports is tapered.

16. The fabrication equipment of claim 13, wherein the ports have a rhomboid cross-section.

17. The fabrication equipment of claim 13 wherein the in-process device is a semiconductor device.

* * * * *

UNITED STATES PATENT AND TRADEMARK OFFICE

CERTIFICATE OF CORRECTION

PATENT NO. : 7,066,074 B2
APPLICATION NO. : 10/733021
DATED : June 27, 2006
INVENTOR(S) : Lin et al.

It is certified that error appears in the above-identified patent and that said Letters Patent is hereby corrected as shown below:

In Col. 8, line 29, delete “part” and insert --port--

Signed and Sealed this

Twenty-first Day of November, 2006

JON W. DUDAS
*Director of the United States Patent and Trademark Office*